US009964019B2

(12) United States Patent
Gopal

(10) Patent No.: US 9,964,019 B2
(45) Date of Patent: May 8, 2018

(54) METHOD AND SYSTEM FOR A DUAL LOOP COOLANT SYSTEM

(71) Applicant: Ford Global Technologies, LLC, Dearborn, MI (US)

(72) Inventor: Ravi Gopal, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 612 days.

(21) Appl. No.: 14/547,950

(22) Filed: Nov. 19, 2014

(65) Prior Publication Data

US 2016/0138878 A1 May 19, 2016

(51) Int. Cl.
*F01P 7/16* (2006.01)
*F01P 3/20* (2006.01)

(52) U.S. Cl.
CPC ..... *F01P 7/165* (2013.01); *F01P 3/20* (2013.01); *F01P 2060/045* (2013.01)

(58) Field of Classification Search
CPC ..... F01P 3/20; F01P 7/16; F01P 7/165; F01P 2060/045; F16H 57/0412; F16H 57/0413; F16H 57/0475; F16H 61/4165
See application file for complete search history.

(56) References Cited

U.S. PATENT DOCUMENTS 4,229,195 A 10/1980 Förg
5,319,963 A * 6/1994 Benford ..... F16H 61/0213 374/141
6,053,131 A 4/2000 Mueller et al.
6,323,613 B1 11/2001 Hara et al.
6,427,640 B1 * 8/2002 Hickey ..... F16H 57/0412 123/41.31
6,772,715 B2 * 8/2004 Pfeffinger ..... F01P 3/20 123/41.31
7,069,880 B2 7/2006 Hutchins
7,261,068 B1 8/2007 Wantschik
7,814,966 B2 10/2010 Prior
8,116,953 B2 * 2/2012 Lopez ..... F16H 57/0413 180/337
8,555,826 B2 10/2013 Feldhaus et al.
2006/0060346 A1 3/2006 Sasaki
2009/0101312 A1 * 4/2009 Gooden ..... F16H 57/0413 165/104.19
2010/0058999 A1 * 3/2010 Arnott ..... F16H 57/0417 123/41.1
2013/0319634 A1 12/2013 Sheppard et al.

* cited by examiner

*Primary Examiner* — Len Tran
*Assistant Examiner* — Hans Weiland
(74) *Attorney, Agent, or Firm* — Julia Voutyras; McCoy Russell LLP

(57) ABSTRACT

Methods and systems are provided for a dual loop coolant system used to control an engine transmission oil temperature. In one example, a high temperature coolant loop comprises a first heat exchanger and a control valve positioned upstream of the first heat exchanger whose coolant flow is separate from a second, low temperature coolant loop containing a second heat exchanger. An engine fluid circuit fluidically coupling the first heat exchanger, second heat exchanger, and an engine system component via a bypass valve positioned between the first heat exchanger and the second heat exchanger.

20 Claims, 3 Drawing Sheets

METHOD AND SYSTEM FOR A DUAL LOOP COOLANT SYSTEM

FIELD

The present description relates generally to methods and systems for a dual loop coolant system.

BACKGROUND/SUMMARY

Coolant systems provide a mechanism for heat transfer between engine components and a heat transfer fluid. Historically, coolant systems have been used to decrease the temperature of an engine block, however, systems have advanced over the years and the desire for temperature control of engine components, beyond cooling, exist. For example, it may be advantageous to heat the engine and/or other engine components during an engine start, but cool the engine and components during high load conditions. Further, the engine may have different heating and/or cooling demands than other engine components.

In order to satisfy this demand, dual loop coolant systems have been introduced and generally contain a high temperature coolant loop and a low temperature coolant loop to manage the temperature of system components. It is advantageous to properly separate the high temperature coolant from the low temperature coolant, otherwise, temperature control of the engine components is compromised. Maintaining the coolant loops separately may present a challenge when both loops feed into a common heat exchanger, such as a transmission oil cooler. Methods and systems exist to address separation of high temperature coolant from low temperature coolant, however, the inventors herein have recognized potential issues with such systems. Dual loop coolant systems may use multiple electronic valves to direct high temperature coolant or low temperature coolant to a common heat exchanger. However, this method is not robust against an operational failure or a system failure where the coolant from the two loops may mix. In addition, these systems are complex and expensive.

As an example, the issues described above may be addressed by a method for a dual loop coolant system with a high temperature coolant loop separated from a low temperature coolant loop. The high temperature coolant loop has a first heat exchanger and the low temperature coolant loop has a second heat exchanger. A control valve is positioned upstream of the first heat exchanger to direct flow of an engine coolant to the first heat exchanger. A bypass valve exists between the first heat exchanger and the second heat exchanger to control flow of an engine component fluid between the two heat exchangers. An engine component is fluidically coupled to the first heat exchanger, the bypass valve, and the second heat exchanger. In this way, the likelihood of the high temperature coolant mixing with the low temperature coolant is reduced.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
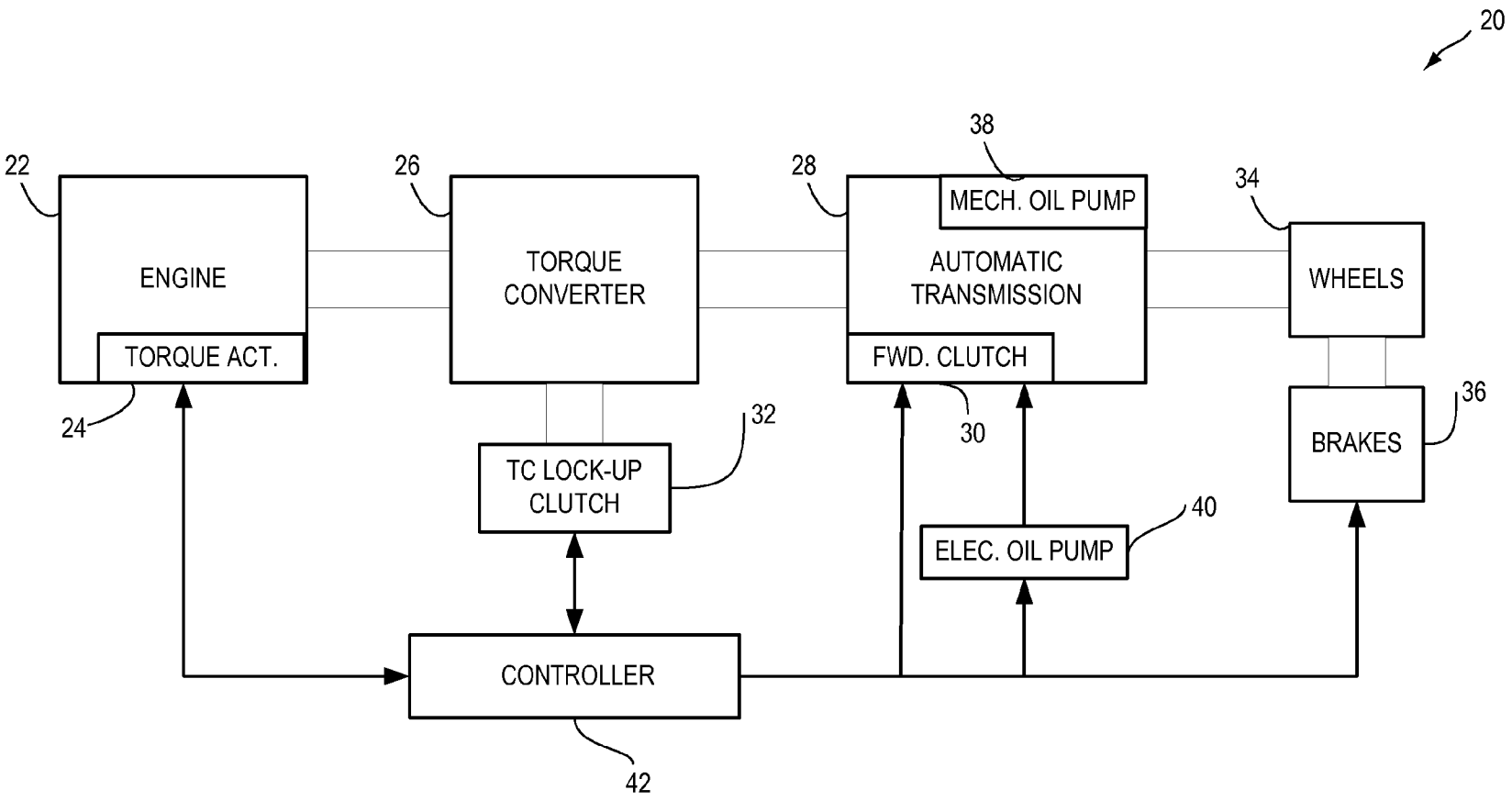
FIG. 1 shows an example vehicle system layout, including details of a vehicle drive-train.
Figure 2:
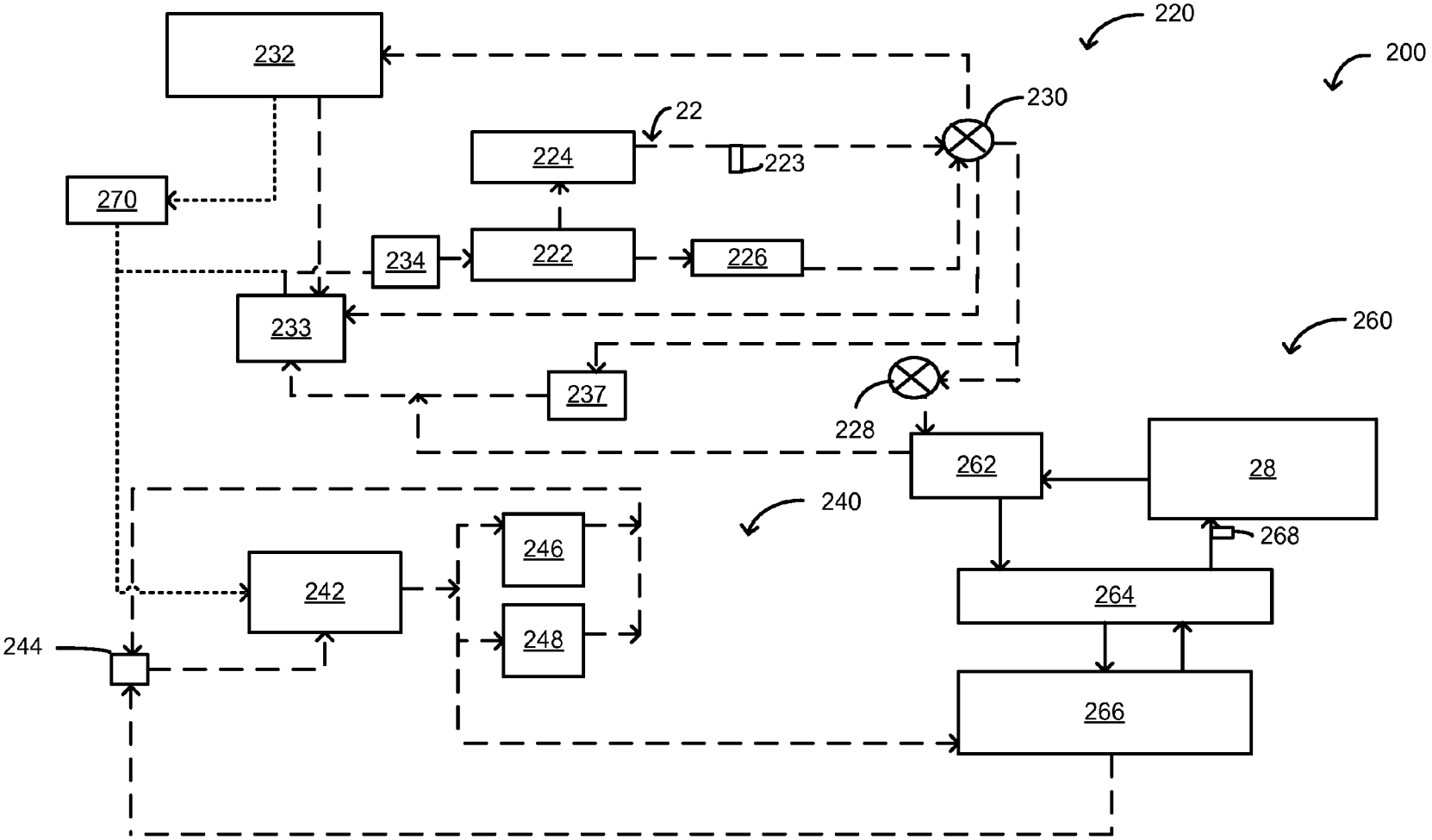
FIG. 2 shows a dual loop coolant flow system.
Figure 3:
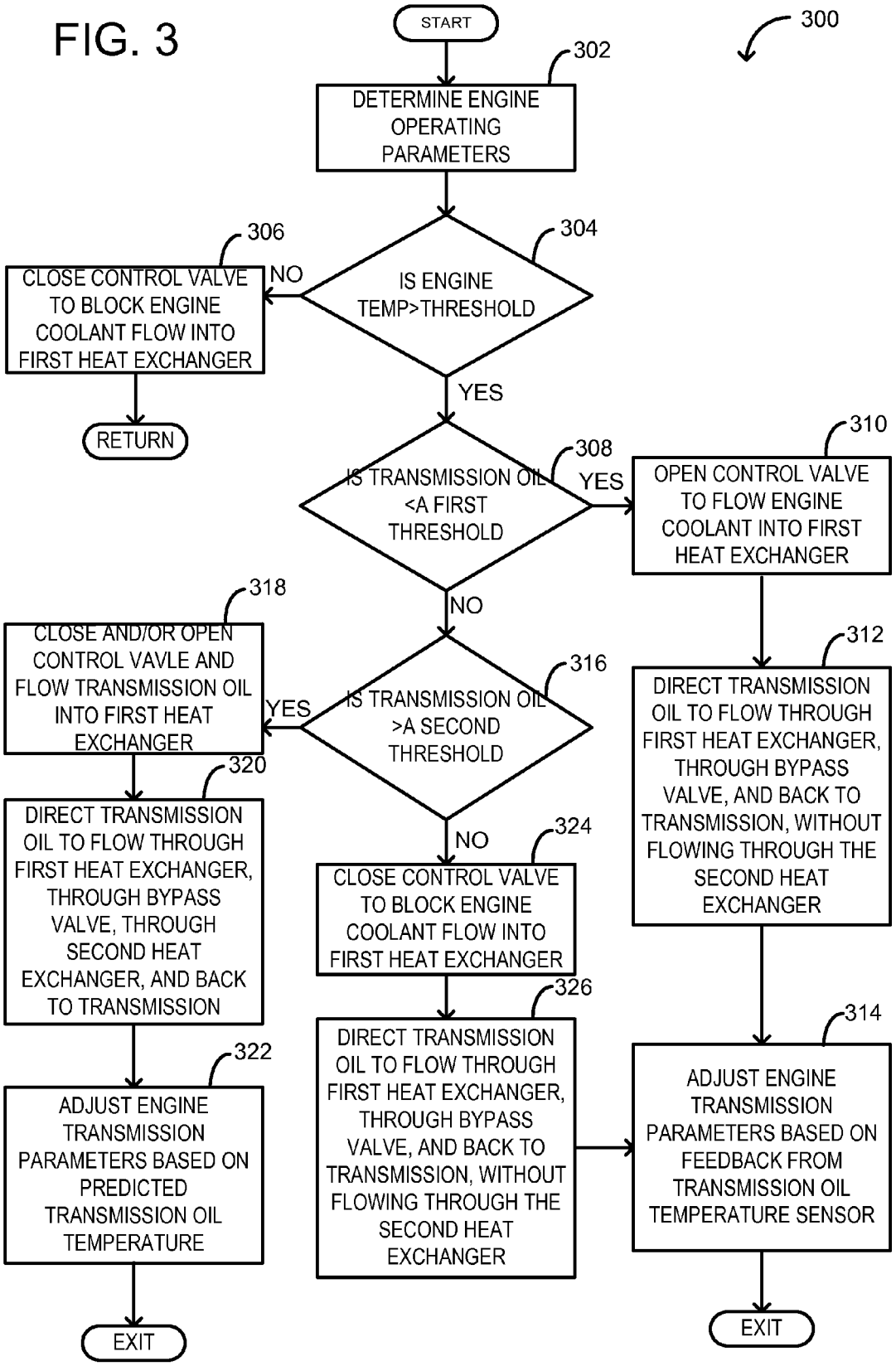
FIG. 3 shows a high-level flow chart detailing a method for controlling a transmission oil temperature.

The following description relates generally to systems and methods for controlling a transmission oil temperature using a dual loop coolant flow system. Increased control of the transmission oil temperature may be accomplished by providing two separate transmission oil heat exchangers, one in a high temperature coolant loop and the other in a separate low temperature coolant loop. FIG. 1 shows a vehicle system including an engine and a transmission. As shown in FIG. 2, an engine transmission system may flow oil from an engine transmission, through a first heat exchanger, through a bypass valve, into a second heat exchanger, and back into the engine transmission. A method for control of the transmission oil temperature is shown in FIG. 3.

FIG. 1 is a block diagram of a vehicle drive-train 20. Drive-train 20 may be powered by engine 22. In one example, engine 22 may be a gasoline engine. In alternate embodiments, other engine configurations may be employed, for example, a diesel engine. Engine 22 may be started with an engine starting system (not shown). Further, engine 22 may generate or adjust torque via torque actuator 24, such as a fuel injector, throttle, etc.

An engine output torque may be transmitted to torque converter 26 to drive an automatic transmission 28 by engaging one or more clutches, including forward clutch 30, where the torque converter may be referred to as a component of the transmission. As such, a plurality of such clutches may be engaged, as needed. The output of the torque converter may in turn be controlled by torque converter lock-up clutch 32. As such, when torque converter lock-up clutch 32 is fully disengaged, torque converter 26 transmits torque to automatic transmission 28 via fluid transfer between the torque converter turbine and torque converter impeller, thereby enabling torque multiplication. In contrast, when torque converter lock-up clutch 32 is fully engaged, the engine output torque is directly transferred via the torque converter clutch to an input shaft (not shown) of transmission 28. Alternatively, the torque converter lock-up clutch 32 may be partially engaged, thereby enabling the amount of torque relayed to the transmission to be adjusted. A controller may be configured to adjust the amount of torque transmitted by the torque converter by adjusting the torque converter lock-up clutch in response to various engine operating conditions, or based on a driver-based engine operation request.

Torque output from the automatic transmission 28 may in turn be relayed to wheels 34 to propel the vehicle. Specifically, automatic transmission 28 may adjust an input driving torque at the input shaft (not shown) responsive to a vehicle traveling condition before transmitting an output driving torque to the wheels.

Further, wheels 34 may be locked by engaging wheel brakes 36. In one example, wheel brakes 36 may be engaged in response to the driver pressing his foot on a brake pedal (not shown). In the same way, wheels 34 may be unlocked by disengaging wheel brakes 36 in response to the driver releasing his foot from the brake pedal.

A mechanical oil pump 38 may be in fluid communication with automatic transmission 28 to provide hydraulic pressure to engage various clutches, such as forward clutch 30 and/or torque converter lock-up clutch 32. Mechanical oil pump 38 may be operated in accordance with torque converter 26, and may be driven by the rotation of the engine or transmission input shaft, for example. Thus, the hydraulic pressure generated in mechanical oil pump 38 may increase as an engine speed increases, and may decrease as an engine speed decreases. An electric oil pump 40, also in fluid communication with the automatic transmission but operating independent from the driving force of engine 22 or transmission 28, may be provided to supplement the hydraulic pressure of the mechanical oil pump 38. Electric oil pump 40 may be driven by a motor (not shown) to which an electric power may be supplied, for example by a battery (not shown).

A controller 42 may be configured to receive inputs, such as from engine 22, transmission 28, and/or various sensors, and trigger one or more actuators (e.g., torque actuator 24) based on the inputs. In some examples, explained in more detail below, the controller may be configured to control coolant flow from the engine to a first heat exchanger and control the flow of a transmission oil to a first heat exchanger and a second heat exchanger. As one example, the coolant flow from the engine to the first heat exchanger may be controlled through a command sent by the controller to a control valve upstream of the first heat exchanger based on an engine temperature. As a second example, the controller may send a command for the opening or closing of a bypass valve within the dual loop cooling system based upon a transmission oil temperature. In all cases, transmission oil temperature control may be performed based on the engine temperature and/or transmission oil temperature. Additional detail regarding control of the transmission oil temperature will be further discussed below with respect to FIGS. 2-3.

Now turning to FIG. 2, a block diagram of a vehicle dual loop cooling system 200 is presented. Vehicle dual loop cooling system 200 includes the engine 22 and the transmission 28 from FIG. 1. The transmission 28 includes a transmission oil temperature sensor 268 upstream of the engine transmission. The engine 22 includes an engine block 222, an engine coolant temperature sensor 223, and an engine cylinder head 224, each included as part of a high temperature coolant loop 220, which also includes a first heat exchanger and a first radiator. The engine coolant temperature sensor will be discussed in more detail in FIG. 3 A separate, low temperature coolant loop 240 includes a second heat exchanger and a second radiator. The transmission 28 is positioned within a transmission oil flow loop 260. Solid lines in FIG. 2 indicate the flow of oil, dashed lines represent the flow of coolant within a coolant loop, and dotted lines represent the flow of coolant to a degasser and back to either the high temperature coolant loop 220 or low temperature coolant loop 240.

The high temperature coolant loop 220 as illustrated comprises an engine block 222 including a coolant jacket, an engine head 224 including a coolant jacket, a turbocharger 226 including a coolant jacket, a control valve 228, coolant flow junction or collector 230, a first radiator 232, a mechanical pump 234, a thermostat and bypass valve assembly 233, and a heater core 237. Coolant within the high temperature coolant loop 220 may circulate through any of the components listed above without mixing with coolant from the low temperature coolant loop 240. As used herein, "without mixing with coolant from the low temperature coolant loop" refers to a coolant flow from a first component to a second component (e.g., from the engine to the first heat exchanger) that is comprised solely of coolant from the high temperature loop, regardless of conditions. That is, only coolant from the high temperature loop flows through and between the components, and not coolant from the low temperature coolant loop.

Coolant from the first radiator 232 may flow to the thermostat and bypass valve assembly 233 (e.g., a radiator bypass), to the mechanical pump 234, and to the engine block 222 coolant jacket without flowing through intervening components and without mixing with coolant from the low temperature coolant loop 240. However, in some examples, intervening components may exist between the mechanical pump 234 and the engine block, for example the coolant may flow through the cylinder head coolant jacket before flowing through the block. Coolant in the engine block 222 coolant jacket may flow to the engine cylinder head 224 coolant jacket and/or turbocharger 226 coolant jacket without flowing through intervening components and without mixing with coolant from the low temperature coolant loop 240. Coolant flows from an open control valve 228 to the first heat exchanger 262. An example of this coolant flow may be seen during a heating operation, which will be described in further detail below.

Coolant from the engine cylinder head 224 and the turbocharger 226 coolant jackets may flow to the coolant flow junction 230 and then to the first radiator 232 when the temperature sensor and bypass valve assembly 233 is open, without mixing with coolant from the low temperature coolant loop 240. In some examples, the temperature sensor and bypass valve assembly 233 may be closed to allow coolant flow to remain in the engine 22 and the turbocharger 226 coolant jackets to expedite coolant heating during a cold engine start. The radiator bypass 233 may direct coolant back to the mechanical coolant pump 234 without flowing to the first radiator 232 and without mixing with coolant from the low temperature coolant loop 240. As another example, the coolant flowing through an open coolant flow junction 230 may flow towards the heater core 237 without mixing with coolant from the low temperature coolant loop 240. Coolant flowing to the heater core 237 may be directed toward control valve 228. Coolant may flow from the control valve 228, to a first heat exchanger 262 and back to a conduit downstream of the heater core 237 and upstream of the radiator bypass 233 without mixing with coolant from the low temperature coolant loop 240. Coolant from the first radiator 232 may also flow to a degas bottle 270.

Now turning to the low temperature coolant loop 240, which as illustrated comprises a second radiator 242, an electric coolant pump 244, a water cooled charge air cooler (WCAC) 246, and a water cooled air conditioner condenser (WCOND) 248. Further, other embodiments of the system, additionally or alternatively, may include a second heat exchanger downstream of the second radiator 242, a coolant control valve upstream of a second heat exchanger, fuel coolers, EGR coolers, electronics, and inverter system control for hybrid electric vehicles. Therefore, coolant flow may deviate from the description below with the introduction of additionally components. An engine coolant may flow from the second radiator 242 to the WCAC 246, to the WCOND 248, and to a second heat exchanger 266 without mixing with coolant from the high temperature coolant loop 220. As used herein "without mixing with coolant from the high temperature coolant loop" refers to a coolant flow from a first component to a second component (e.g., from the second radiator to the second heat exchanger) that is comprised solely of coolant from the low temperature loop, regardless of conditions. That is, only coolant from the low temperature loop flows through and between the components, and not coolant from the high temperature coolant loop. Coolant may flow from the second radiator 242, to the second heat exchanger 266, to electric pump 244, and back to the second radiator 242. The second heat exchanger will be described in more detail below. Coolant from the WCAC 246 may flow to the electric pump 244 and then to the second radiator 242 without mixing with coolant from the high temperature coolant loop 220. Coolant from the WCOND 248 may flow to the electric pump 244 and then to the second radiator 242 without mixing with coolant from the high temperature coolant loop 220. It will be appreciated by someone skilled in the art that the coolant in the low temperature coolant loop 240 remain separated from coolant in the high temperature coolant loop 220 with the introduction of additional components in further embodiments as described above. Coolant from the degas bottle may flow to mechanical pump 234 in the high temperature coolant loop 220 and/or to the second radiator 242 in the low temperature coolant loop 240. In some examples, rather than collecting in a common degas bottle, the coolant in the low temperature coolant loop may collect in a separate degas bottle.

Now turning to transmission oil flow circuit 260, it comprises the transmission 28, the first heat exchanger 262, a bypass valve 264, and the second heat exchanger 266. The transmission oil flow circuit directs transmission oil from the engine transmission to the first heat exchanger, the second heat exchanger, and back to the engine transmission when the bypass valve is open. The first and second heat exchangers are liquid-to-liquid heat exchangers, which transfer heat between coolant and an engine fluid (e.g., transmission oil). During a cooling operation, oil from transmission 28 may flow to the first heat exchanger 262, to the bypass valve 264, to the second heat exchanger 266, back through the bypass valve 264 and into the transmission 28. In some examples, transmission oil in the second heat exchanger 266 may flow to the transmission 28 without flowing back through bypass valve 264, via a conduit leading from the second heat exchanger 266 to the transmission 28 (not shown). During a heating operation, oil may flow from the transmission 28 to the first heat exchanger 262, to the bypass valve 264, and back to the transmission 28 without flowing through the second heat exchanger 266.

During the cooling operation, the bypass valve 264 is open and the control valve 228 is in a closed position to prevent the flow of hot coolant from the high temperature coolant loop 220 to the first heat exchanger 262. Additionally or alternatively, control valve 228 may be open only if the high temperature loop coolant temperature is less than the transmission oil temperature. This may provide the transmission oil with further cooling. When heat is transferred from a first element to a second element, this implies that under such conditions the first element is at a higher temperature than the second element (e.g., a transmission oil is cooled by coolant from a high temperature coolant loop and then further cooled by coolant from a low temperature coolant loop when the transmission oil temperature is greater than the high temperature coolant loop coolant temperature). However, if the high temperature coolant loop coolant temperature is above the transmission oil temperature, then the control valve 228 is in a closed position Oil flows from the transmission 28, to the first heat exchanger 262, to the bypass valve 264, to the second heat exchanger 266, back into the bypass valve 264, and into the transmission 28. When heat is transferred from a first element to a second element, this implies that under such conditions the first element is at a higher temperature than the second element (e.g., the transmission oil is cooled by the coolant from the low temperature coolant loop). As mentioned above, in other examples transmission oil in the second heat exchanger 266 may flow directly to transmission 28 without flowing through the bypass valve. Transmission oil in the second heat exchanger 266 is cooled because the coolant in the low temperature coolant loop 240 is lower in temperature than the transmission oil. Bypass valve 264 opens in response to the transmission oil being greater than a second threshold via either a solenoid actuator or a wax actuator. The solenoid actuated valve opens via a signal sent by the controller in response to the transmission oil temperature being greater than a threshold. The wax actuated valve is set to open when an amount of wax melts during instances of the transmission oil temperature being greater than a threshold. The cooling operation may begin due to the transmission oil being greater than a second threshold described in FIG. 3. Along with the cooling operation, a heating operation, a hold operation, and an engine warm up operation exist. During the heating operation, the hold operation, and the engine warm up operation, the bypass valve is closed, and during the cooling operation, the bypass valve is open.

During the heating operation, the bypass valve 264 is closed and the control valve 228 is in an open position to allow the flow of hot coolant from the engine (e.g., a coolant jacket in the cylinder block or head) to the first heat exchanger 262, without mixing with coolant from the low temperature coolant loop 240. When heat is transferred from a first element to a second element, this implies that under such conditions the first element is at a higher temperature than the second element (e.g., high temperature coolant heats the transmission oil). In another example, coolant may be delivered to the first heat exchanger from a coolant source upstream of the first radiator within the high temperature coolant loop, such as downstream of the turbocharger. Furthermore, coolant may be delivered to the first heat exchanger from a coolant source parallel to the heater core. Oil flows from the transmission 28 to the first heat exchanger 262, through bypass valve 264, and back into transmission 28 without flowing to the second heat exchanger.

During a hold and an engine warm up operation, the bypass valve 264 is closed and the control valve 228 is in a closed position to prevent the flow of hot coolant from the high temperature coolant loop 220 to the first heat exchanger. These parameters allow the oil to maintain its current temperature as it flows from the transmission 22, to the first heat exchanger 262, to the bypass valve 264, and back into the transmission 28. In the above described examples, the coolant in the low temperature loop flows through the second exchanger, regardless of conditions. However, in some examples, a valve may be positioned upstream of the second heat exchanger to control flow of coolant through the second heat exchanger.

The above-described dual loop coolant system is illustrated as exchanging heat with transmission oil via the first and/or second heat exchangers. However, other engine fluids may alternatively or additionally be cooled and/or heated by the dual loop coolant system. As an example, the engine fluid may also be engine oil or brake fluid.

Turning now to FIG. 3, a high-level flow chart detailing instructions for the operation and use of components in FIG. 2 to control transmission oil temperature is presented. Method 300 may be performed by a controller (e.g., controller 42 of FIG. 1) according to non-transitory computer-readable instructions stored thereon. Method 300 may begin by determining the current engine parameters (e.g., engine speed and engine load, engine temperature) at 302. At 304, the controller may determine if an engine temperature is greater than a cold start threshold. As an example, the engine temperature may be measured by the engine coolant temperature sensor 223. If the engine temperature is below the cold start threshold, then the controller may enter an engine warm up operation, wherein the controller instructs the control valve to close in order to block engine coolant flow to the first heat exchanger at 306. As an example, if the engine is operating under cold engine start conditions, the engine coolant temperature may be lower than a threshold (e.g., at ambient temperature) and it may be preferred to block the coolant flow to the first heat exchanger to permit the coolant to reach a temperature above the threshold. The method may then return to 304 until the engine temperature is above the cold start threshold. The cold start threshold may be based on a normal engine operating temperature (e.g., a range from 190-220° F.) and/or an engine warm up coolant temperature demand. As another example, the controller may allow coolant to flow into the first heat exchanger during an engine cold start to allow the transmission oil temperature to increase simultaneously with the engine. If the engine temperature is above the cold start threshold, the method may proceed to 308. At 308, the controller determines if the transmission oil temperature is less than a first threshold. The first threshold may be based on a lower value of a normal operating temperature range for transmission oil. As an example, if 190-220° F. is the normal operating temperature range for transmission oil, then the first threshold may be set based on a value at or slightly below 190° F., such as 180° F. The transmission oil temperature may be measured by the transmission oil temperature sensor 268. If the answer is yes, the method may proceed to 310 and if the answer is no, the method may proceed to 316. 316 and other operations of method 300 will be discussed in further detail below.

At 310, the controller opens the control valve to flow coolant from the engine through the first heat exchanger. At 312, transmission oil is directed to flow through the first heat exchanger, transferring heat from the engine coolant to the transmission oil. During the heating operation, coolant from the first, high temperature coolant loop flows to the first heat exchanger, while keeping the coolant in the first coolant loop separate from coolant in the second, low temperature coolant loop. After the transmission oil flows through the first heat exchanger from the engine transmission, the oil then flows into the bypass valve and back into the engine transmission. When the bypass valve is closed, transmission oil flows from the engine transmission to the first heat exchanger and back to the engine transmission, without flowing through the second heat exchanger. The bypass valve may be either wax actuated or solenoid actuated. If the valve is wax actuated, the bypass valve will remain closed if the transmission oil temperature is below the second threshold. If the valve is solenoid actuated, the bypass valve will receive a signal from the controller to close based on the transmission oil temperature being below the second threshold.

At 314, method 300 includes adjusting one or more transmission parameters based on feedback from a transmission oil temperature sensor. During typical operation of the engine transmission, the temperature of the transmission oil is measured using the transmission oil temperature sensor. This temperature measurement is used to determine the viscosity of the transmission oil, which affects the transmission oil pressure and/or friction. As the transmission oil pressure and/or friction changes, one or more components in the transmission may be adjusted, such as the electric transmission oil pump, various clutches within the transmission, the output of the transmission (e.g., the transmission output shaft and/or wheel torque), and/or other components, in order to maintain desired wheel torque. The method may exit.

If the answer to 308 is no and the transmission oil temperature is above the first threshold, the method may proceed to 316. At 316, the method determines if the transmission oil temperature is above a second threshold. The second threshold may be based on an upper value of a normal operating temperature range for transmission oil. As an example, if 190-220° F. is the normal operating temperature range for transmission oil, then the second threshold may be set based on a value at or slightly above 220° F. If the answer is no, the method may proceed to 324 and function in a hold operation. The hold operation will be discussed in further detail below. If the transmission oil temperature is greater than the second threshold then the method may proceed to 318.

At 318, the controller sends a signal to close the control valve to block engine coolant flow into the first heat exchanger to prevent heating of the transmission oil coolant because the transmission oil temperature is above the second threshold. As another example, the control valve may be open if the high temperature loop coolant temperature is less than the transmission oil temperature to provide further cooling to the transmission oil. The transmission oil from the engine transmission flows into the first heat exchanger and then flows into the open bypass valve where it is directed to flow into the second heat exchanger 320. As discussed above, the bypass valve may be solenoid actuated or wax actuated. If the bypass valve is solenoid actuated, the controller sends a signal to open the bypass valve based on the transmission oil temperature being above the second threshold. If the bypass valve is wax actuated, the valve will open because the wax will melt in the presence of a transmission oil at a temperature above the second threshold. As the transmission oil from the engine transmission flows in the second heat exchanger, coolant from the second coolant loop flows into the second heat exchanger and decreases the transmission oil temperature. As an example, the cooled transmission oil in the second heat exchanger may flow back into the bypass valve and back into the engine transmission, as shown in FIG. 2. As a second example, the cooled transmission oil in the second heat exchanger may flow directly back into the engine transmission from the second heat exchanger.

At 322, method 300 includes adjusting one or more transmission parameters based on a predicted transmission oil temperature. When the transmission system initially enters the cooling operation, the transmission oil may undergo a rapid change in temperature due to the opening of the bypass valve and the flow of the transmission oil through the second heat exchanger. This rapid change in transmission oil temperature may occur at a faster rate than is detectable by the transmission oil feedback control described above. As a result, a delay may exist between the time the transmission oil temperature actually changes and the time the transmission system is able to detect and respond to the change in transmission oil temperature. Such a delay may result in undesired torque disturbances, for example. To counteract this delay, once the bypass valve has opened, the transmission feedback control may utilize a predicted transmission oil temperature rather than relying on feedback from the transmission oil sensor. The transmission oil temperature may be predicted in a suitable manner, for example based on a temperature of the coolant in the low temperature coolant loop at the inlet of the second heat exchanger, temperature drop across the second heat exchanger, flow rate of coolant through the second exchanger, flow rate of transmission oil through the second heat exchanger, initial transmission oil temperature, and/or other parameters. The bypass valve may be determined to have opened based on a signal sent from the controller commanding the bypass valve to open (if the bypass valve is actuated by a solenoid) and/or based on a predicted opening of the bypass valve (if the bypass valve is wax-actuated, for example), where the bypass valve is predicted to have opened based on engine operating conditions (e.g., engine speed and load). In this way, responsive to the bypass valve opening, one or more components of the transmission may be adjusted (e.g., transmission oil pump, clutch engagement/disengagement, selected transmission gear) based on a predicted transmission oil temperature. The method may exit.

If the answer at 316 is no and the transmission oil is not greater than the second threshold, then it may be determined that the transmission oil is operating at a desired operating temperature. The method may proceed to 324 to conduct a hold operation. Method 300 may enter a hold operation when it is determined that the engine transmission oil temperature is above the first threshold and below the second threshold. At 324, the controller sends a signal to close the control valve to prevent heat transfer from the engine coolant and the transmission oil at the first heat exchanger. At 326, the transmission oil flows from the engine transmission through the first heat exchanger, through the bypass valve, and back to the transmission, without flowing to the second heat exchanger. The method then proceeds to 314 to maintain and/or adjust transmission parameters based on feedback from the transmission oil temperature sensor, and then method 300 exits.

Method 300 represents an exemplary method for controlling an engine transmission oil temperature with the use two separate heat exchangers and a control valve and a bypass valve within a dual loop coolant system. In this way, by maintaining coolant in the first coolant loop separate from coolant in the second coolant loop, the system is granted a higher degree of temperature control. Separating the two coolant loops from one another as discussed in this application, removes the possibility of a system failure mixing the high temperature coolant with the low temperature coolant.

The technical effect of separating a first coolant loop from a second coolant loop enables the dual loop coolant system the ability to increase control of transmission oil temperatures. The first coolant loop is a high temperature coolant loop comprising at least an engine coolant jacket and a first radiator, where coolant exiting the engine coolant jacket flows to the first heat exchanger when the control valve is open without mixing with coolant from the second loop. The second coolant loop is a low temperature coolant loop comprising at least a second radiator, where coolant exiting the second radiator flows to the second heat exchanger without mixing with coolant from the first loop. By eliminating any possibility of the two coolants mixing with one another, the issue of high temperature coolant mixing with low temperature coolant is not likely.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

An embodiment of a system comprises an engine having a first coolant loop including a first heat exchanger and a control valve positioned upstream of the first heat exchanger, a second coolant loop, separate from the first coolant loop, including a second heat exchanger, and an engine fluid circuit fluidically coupling the first heat exchanger, second heat exchanger, and an engine system component via a bypass valve positioned between the first heat exchanger and the second heat exchanger. The method further comprising the control valve being a solenoid-actuated valve or a wax-actuated valve.

The method, additionally or alternatively, may include the first coolant loop being a high temperature coolant loop comprising at least an engine coolant jacket and a first radiator, where coolant exiting the engine coolant jacket flows to the first heat exchanger when the control valve is open. The second coolant loop is a low temperature coolant loop comprising at least a second radiator, where coolant exiting the second radiator flows to the second heat exchanger.

The method, additionally or alternatively, may include the engine fluid circuit being a transmission oil circuit where transmission oil flows from an engine transmission to the first heat exchanger, the bypass valve, the second heat exchanger, and back to the engine transmission when the bypass valve is open. When the bypass valve is closed, transmission oil flows from the engine transmission to the first heat exchanger and back to the engine transmission, without flowing through the second heat exchanger. The method further comprising a controller with computer-readable instructions for opening the control valve to flow coolant from the first coolant loop through the first heat exchanger in order to transfer heat from the coolant from the first coolant loop to the transmission oil during a heating operation, closing the control valve to block coolant from the first coolant loop from flowing through the first heat exchanger during a cooling operation when coolant in the first loop is greater than a transmission oil temperature; and, opening the control valve to allow coolant from the first coolant loop to flow through the first heat exchanger during a cooling operation when coolant in the first loop is less than the transmission oil temperature. The computer-readable instructions, additionally or alternatively, may further comprise instructions for, during one or more of a hold operation or an engine warm up operation, closing the control valve to block coolant from the first coolant loop from flowing through the first heat exchanger and maintaining a current transmission oil temperature. During the heating operation and the hold operation, the bypass valve is closed, and during the cooling operation, the bypass valve is open.

The method, additionally or alternatively, may include the transmission oil flowing from the engine transmission, through the first heat exchanger, into the bypass valve, and back to the engine transmission during the heating operation. The transmission oil flowing from the first heat exchanger and the bypass valve, into the second heat exchanger, and back to the engine transmission during the cooling operation. The transmission oil flowing from the first heat exchanger, into the bypass valve, and back into the transmission during one or more of the hold operation and the engine warm up operation.

Another method for an engine comprises transferring heat from a first coolant loop to a transmission fluid via a first heat exchanger during a first condition, transferring heat from the transmission fluid to a second coolant loop via a second heat exchanger during a second condition, reducing a transfer of heat between the transmission fluid and one or more of the first coolant loop and the second coolant loop during a third condition, and maintaining coolant in the first coolant loop separate from coolant in the second coolant loop during the first, second, and third conditions.

The method, additionally or alternatively, may include the transmission fluid comprising engine transmission oil, wherein the first condition is different than and mutually exclusive with the second condition. Transferring heat from the first coolant loop to the transmission fluid via the first heat exchanger comprises opening a control valve positioned in the first coolant loop upstream of the first heat exchanger to flow coolant from an engine coolant jacket to the first heat exchanger, and flowing the transmission fluid from an engine component through the first heat exchanger and back to the engine component without flowing through the second heat exchanger.

The method, additionally or alternatively, may include wherein transferring heat from the transmission fluid to the second coolant loop via the second heat exchanger comprises closing the control valve to block coolant from the engine jacket from flowing through the first heat exchanger when the coolant temperature from the engine jacket is greater than the transmission fluid temperature, and flowing the transmission fluid from the engine component through the first heat exchanger, the second heat exchanger, and back to the engine component and opening the control valve to allow coolant from the engine jacket to flow through the first heat exchanger when the coolant temperature from the engine jacket is less than the transmission fluid temperature, and flowing the transmission fluid from the engine component through the first heat exchanger, the second heat exchanger, and back to the engine component. During both the first and second conditions, coolant from the second loop flows through the second heat exchanger. The first condition comprises the transmission fluid temperature being below a first threshold temperature and the second condition comprises transmission fluid temperature being above a second threshold temperature, greater than the first threshold temperature.

Another method for an engine comprises controlling a temperature of transmission oil via a control valve controlling flow of a coolant from a first coolant loop to a first heat exchanger and controlling a flow of the transmission oil into a second heat exchanger via a bypass valve based on the temperature of the transmission oil, the second heat exchanger receiving coolant from a second coolant loop, separate from the first coolant loop. Controlling the temperature of the transmission oil via the control valve comprises increasing the temperature of the transmission oil by opening the control valve and maintaining the temperature of the transmission oil by closing the control valve, wherein the first coolant loop is a high temperature loop where coolant flows from an engine coolant jacket to the first heat exchanger, and wherein the second coolant loop is a low temperature loop where coolant flows from a radiator to the second heat exchanger.

The method, additionally or alternatively, may include adjusting one or more components of an engine transmission based on a predicted transmission oil temperature to maintain desired wheel torque responsive to the bypass valve opening. When the bypass valve is closed, adjusting one or more components of an engine transmission based on feedback from a transmission oil temperature sensor to maintain desired wheel torque.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

a first coolant loop including a first heat exchanger, a first radiator, and a control valve positioned upstream of the first heat exchanger, wherein after coolant exits the first radiator, a portion of the coolant in the first coolant loop flows back to the first radiator while bypassing the first heat exchanger and a remaining portion of the coolant in the first coolant loop flows through the first heat exchanger via the control valve;

a second coolant loop, separate from the first coolant loop, including a second heat exchanger a second radiator, a charge air cooler, and an air conditioning condenser, wherein after coolant exits the second radiator, a portion of coolant in the second coolant loop flows back to the second radiator while bypassing the second heat exchanger and a remaining portion of the coolant in the second coolant loop flows to the second heat exchanger; and an engine fluid circuit fluidically coupling the first heat exchanger in series with the second heat exchanger, and an engine system component via a bypass valve positioned between the first heat exchanger and the second heat exchanger.

2. The system of claim 1, wherein the first coolant loop is a high temperature coolant loop comprising at least an engine coolant jacket, the first radiator, and a heater core, wherein the coolant exiting the first radiator flows through the engine coolant jacket and then the portion of the coolant in the first coolant loop flowing back to the first radiator flows through the heater core and the remaining portion of the coolant in the first coolant loop flows to the first heat exchanger when the control valve is open.

3. The system of claim 2, wherein the second coolant loop is a low temperature coolant loop, wherein after the coolant exits the second radiator, the portion of the coolant in the second coolant loop flowing back to the second radiator flows through one or more of the charge air cooler and the air conditioning condenser, and the remaining portion of the coolant in the second coolant loop flows to the second heat exchanger.

4. The system of claim 3, wherein the engine fluid circuit is a transmission oil circuit where transmission oil flows, in series, from an engine transmission to the first heat exchanger, then through the bypass valve, and then through the second heat exchanger, and then back to the engine transmission when the bypass valve is open.

5. The system of claim 4, wherein when the bypass valve is closed, transmission oil flows from the engine transmission to the first heat exchanger and then back to the engine transmission, without flowing through the second heat exchanger.

6. The system of claim 5, further comprising a controller with computer-readable instructions for:

during a heating operation, opening the control valve to flow coolant from the first coolant loop through the first heat exchanger in order to transfer heat from the remaining portion of the coolant from the first coolant loop to the transmission oil;

during a first cooling operation when coolant in the first coolant loop is greater than a transmission oil temperature, closing the control valve to block the remaining portion of coolant from the first coolant loop from flowing through the first heat exchanger; and during a second cooling operation when coolant in the first coolant loop is less than the transmission oil temperature, opening the control valve to allow the remaining portion of coolant from the first coolant loop to flow through the first heat exchanger.

7. The system of claim 6, wherein the computer-readable instructions further comprise instructions for, during one or more of a hold operation or an engine warm up operation, closing the control valve to block the remaining portion of coolant from the first coolant loop from flowing through the first heat exchanger and maintaining a current transmission oil temperature.

8. The system of claim 7, wherein during the heating operation and the hold operation, the bypass valve is closed, and during each of the first and second cooling operations, the bypass valve is open.

9. The system of claim 7, wherein the transmission oil flows from the engine transmission, through:

the first heat exchanger, into the bypass valve, and back to the engine transmission during the heating operation;

the first heat exchanger and the bypass valve, into the second heat exchanger, and back to the engine transmission during each of the first and second cooling operations; and the first heat exchanger, into the bypass valve, and back into the engine transmission during one or more of the hold operation and the engine warm up operation.

10. The system of claim 1, wherein the control valve is a solenoid-actuated valve or a wax-actuated valve.

11. A method, comprising:

during a first condition, transferring heat from a first coolant loop to a transmission fluid via a first portion of coolant from the first coolant loop flowing through a first heat exchanger, a remaining portion of coolant from the first coolant loop flowing to a first radiator while bypassing the first heat exchanger;

during a second condition, transferring heat from the transmission fluid to a second coolant loop via a second heat exchanger via a second portion of coolant from the second coolant loop flowing through the second heat exchanger, a remaining portion of coolant from the second coolant loop flowing to a second radiator while bypassing the second heat exchanger, the second heat exchanger coupled in series to the first heat exchanger via a bypass valve, the second coolant loop further including a charge air cooler and an air conditioning condenser;

during a third condition, reducing a transfer of heat between the transmission fluid and one or more of the first portion of coolant from the first coolant loop and the second portion of coolant from the second coolant loop; and during each of the first, second, and third conditions, maintaining coolant in the first coolant loop separate from coolant in the second coolant loop.

12. The method of claim 11, wherein the transmission fluid comprises engine transmission oil, wherein the first condition is different than and mutually exclusive with the second condition, wherein the first coolant loop further includes a heater core, the remaining portion of coolant from the first coolant loop flowing to the first radiator via the heater core, and the remaining portion of coolant from the second coolant loop flowing to the second radiator via one of the charge air cooler and the air conditioning condenser.

13. The method of claim 11, wherein transferring heat from the first coolant loop to the transmission fluid via the first heat exchanger comprises:

opening a control valve positioned in the first coolant loop upstream of the first heat exchanger to flow the first portion of coolant from an engine coolant jacket to the first heat exchanger; and flowing the transmission fluid from an engine component through the first heat exchanger and back to the engine component without flowing through the second heat exchanger.

14. The method of claim 13, wherein transferring heat from the transmission fluid to the second coolant loop via the second heat exchanger comprises:

closing the control valve to block the first portion of coolant from the engine coolant jacket from flowing through the first heat exchanger when a coolant temperature from the engine coolant jacket is greater than a transmission fluid temperature, and flowing the transmission fluid from the engine component through the first heat exchanger, the second heat exchanger, and back to the engine component; and opening the control valve to allow the first portion of coolant from the engine coolant jacket to flow through the first heat exchanger when the coolant temperature from the engine coolant jacket is less than the transmission fluid temperature, and flowing the transmission fluid from the engine component through the first heat exchanger, the second heat exchanger, and back to the engine component.

15. The method of claim 14, wherein during both the first and second conditions, the second portion of coolant from the second coolant loop flows through the second heat exchanger.

16. The method of claim 11, wherein the first condition comprises transmission fluid temperature below a first threshold temperature and the second condition comprises transmission fluid temperature above a second threshold temperature, greater than the first threshold temperature.

17. A method, comprising:

controlling a temperature of transmission oil via a control valve controlling a flow of a portion of all coolant from a first coolant loop to a first heat exchanger; and controlling a flow of the transmission oil from the first heat exchanger into a second heat exchanger, arranged in series to the first heat exchanger via a bypass valve, based on the temperature of the transmission oil, the second heat exchanger receiving a portion of all coolant from a second coolant loop, separate from the first coolant loop, the second coolant loop including a charge air cooler and an air conditioning condenser.

18. The method of claim 17, wherein controlling the temperature of the transmission oil via the control valve comprises increasing the temperature of the transmission oil by opening the control valve and maintaining the temperature of the transmission oil by closing the control valve, wherein the first coolant loop is a high temperature loop where the portion of coolant from the first coolant loop flows from an engine coolant jacket to the first heat exchanger while a remaining portion of coolant flows back to a first radiator via a heater core, and wherein the second coolant loop is a low temperature loop where a portion of coolant flows from a second radiator to the second heat exchanger while a remaining portion of coolant flows back to the second radiator via one of the charge air cooler and the air conditioning condenser.

19. The method of claim 17, further comprising, responsive to the bypass valve opening, adjusting one or more components of an engine transmission based on a predicted transmission oil temperature.

20. The method of claim 17, further comprising, when the bypass valve is closed, adjusting one or more components of an engine transmission based on feedback from a transmission oil temperature sensor.

* * * * *